US005700768A

United States Patent [19]

Lu

[11] Patent Number: 5,700,768

[45] Date of Patent: Dec. 23, 1997

[54] FLOOR CLEANING COMPOSITIONS

[75] Inventor: Robert Zhong Lu, Mahwah, N.J.

[73] Assignee: Reckitt & Colman Inc., Montvale, N.J.

[21] Appl. No.: 519,133

[22] Filed: Aug. 24, 1995

[51] Int. Cl.[6] ..... C11D 1/83

[52] U.S. Cl. ..... 510/214; 510/242; 510/365; 510/418

[58] Field of Search ..... 510/214

[56] References Cited

U.S. PATENT DOCUMENTS 3,239,468 3/1966 Herrick ..... 510/214
3,342,739 9/1967 Corey et al. ..... 510/214
3,970,595 7/1976 Ginn et al. ..... 510/214
5,350,541 9/1994 Michael et al. ..... 510/214

*Primary Examiner*—Jacqueline V. Howard
*Attorney, Agent, or Firm*—Fish & Richardson P.C.

[57] ABSTRACT

Improved floor cleaning compositions featuring low residue/film formation, methods for their production and processes for their use are disclosed. The compositions are aqueous floor cleaning compositions comprising a non-ionic surfacant having an average molecular weight of about 2,000 and greater, a clarifying effective amount of an amphoteric solubilizer, and an anionic low foaming surfactant. Further optional constituents may also be included.

28 Claims, No Drawings

FLOOR CLEANING COMPOSITIONS

The present invention is directed to improved floor cleaning compositions.

A wide variety of floor cleaning compositions, particularly floor cleaning compositions which are specifically formulated to address the particular technical requirements of different flooring materials, or to address the specific technical problems associated with the treatment and/or removal of particular classes of soils from particular flooring materials are known. Examples of such floor cleaning compositions include the following.

U.S. Pat. No. 4,230,605 to Connelly et al. is directed to a floor cleaning composition which is particularly directed to the maintenance of the high gloss level of "no-wax" products. The cleaning compositions consists essentially of an aqueous emulsion of a terpolymer having an average molecular weight of about 23,000, said terpolymer being an addition polymer based on about 51% by weight methyl methacrylate, 31% by weight butyl acrylate and 18% by weight of acrylic acid. Further essential constituents include a particular surfactant, (at a preferred ratio the terpolymer to the surfactant is 80:20 parts by weight,) a solvent such as ethylene glycolmonobutylether and ammonia which is necessary to solubilize the terpolymer. Water in a large proportion is the final essential constituent. Further optional conventional additives such as those known to the art may also be added.

U.S. Pat. No. 4,289,640 to Falivene is directed to a cleaning powder featuring improved grease cutting and foaming characteristics. The cleaning powder comprises a particulate base material which function as the abrasive or polishing agent, a detergent builder salt or salts, a synthetic organic detergent and an organic hydrotrope. Recited as among useful synthetic organic detergents are an extremely broad class of anionic, cationic, amphoteric or nonionic surfactants which are recited at column 3, line 42 through column 5, line 27 of the specification.

U.S. Pat. No. 4,347,153 to Hooper et al. provides a deodorant abrasive cleaner for surface treatment wherein said surfaces are other than the human body. The deodorant product described therein is essentially a deodorant composition which is incorporated into a carrier wherein such carrier is chosen from a wide array of abrasive cleaners, bleaching agents, waxes, film foaming polymers as well as mixtures thereof. The compositions of the patent are intended for the suppression of malodors and may be provided to a wide variety of surfaces including ceramic sanitary appliances, kitchen surfaces, floors and walls, and the like.

U.S. Pat. No. 4,425,266 to Beck et al. provides improved floor cleaning compositions which floor cleaning compositions are differentiated over prior art compositions comprising N-phenyldiethanolamine as the polymer dissolving component. The Beck specification teaches the addition of certain N-oxalkylated derivatives of an aniline including the reaction products of o-toluidine, p-toluidine, p-phenylenediamine, as well as N-methyl-aniline, with a corresponding numbers of moles of ethylene oxide or propylene oxide in the presence of alkaline catalyst. These N-oxalkylated derivatives of aniline are cited as not imparting a characteristic blue coloration tinge which was cited as a detrimental feature of the use of N-phenyldiethanolamine of prior compositions. The floor cleaning compositions are cited as being useful with hard flooring surfaces, such as PVC flooring tiles.

U.S. Pat. No. 5,191,002 to Davis teaches a low zinc, low phosphate, acrylic based integrated floor care maintenance system which is useful for the cleaning of various types of flooring. The said floor care maintenance system is taught as a two-part system which includes as a first part, a low zinc and low phosphate comprising acrylic floor finish composition, and a second component, a floor finish stripper having no added zinc nor added phosphate and which further includes up to 5% by weight of an ammonium perfluoryl alkyl sulfonate. The floor finish stripper composition may include further constituents including certain surfactants, organic acids and certain salts.

U.S. Pat. No. 4,861,518 to Morganson et al. provides certain improved solid floor cleaning concentrate compositions which solid compositions are ultimately intended to be diluted and mixed by the consumer or other end user at the time of application to the flooring surface. The solid floor cleaner composition comprises generally 7–16% by weight of at least one surfactant, but preferably two different nonionic surfactants, 5–20% by weight of an organic solvent which is able to solubilize greasy stains such as monoethanolamine, ethyleneglycolmonobutylether, or diethyleneglycolmonoethylether; an alkali such as potassium hydroxide or sodium hydroxide so to maintain the pH of the solid cleaning concentrate composition at a pH of at least 9, but preferably, 11.5 to 12; and 15–50% by weight of a water soluble organic carrier which creates a solid matrix which is desirably a polyethylene glycol of 3,000–8,000 molecular weight. The cleaning composition concentrates taught therein are formed by first heating all of the constituents so to form a molten mixture therefrom, and subsequently casting said molten composition preferably into capsule containers.

U.S. Pat. No. 5,266,088 is directed to a water-based polish composition. Said polish composition is recited being particularly useful for the polishing of non-porous surfaces. The composition comprises 1–3% of a thickener such as an industrial gum or synthetic polymer, 5–13% by weight of at least one particulate abrasive material, and optionally, but preferably, at least one surfactant selected from a broad class of anionic, cationic, nonionic and amphoteric surfactants, and the balance, water. The composition provides a shelf stable dispersion of the particulate abrasive in the water-based composition wherein the abrasive material is readily redispersed by manual shaking of the container when the cleaning composition is in a liquid form. The compositions are particularly useful for the cleaning of non-porous surfaces including a wide variety of glass, metal, plastic, ceramic, semi-conducting materials, metallurgical and geological specimens, painted surfaces, waxed surfaces, glass, plastic, anodized aluminum surfaces, and are particularly cited as being very useful in the polishing of wax floors and marble floors. The presence of the finely divided particulates in the compositions are taught to be useful in the removal of surface scratches on said hard surfaces.

While these compositions may be effective in addressing the individual needs of particular flooring compositions, not all of them are readily useful for a variety of varying flooring materials. Additionally, one or more of the above recited compositions are not readily or quickly applied to a roofing surface and with little effort restore a substantial amount of a floor's glossy sheen or appearance. This is particularly true of wooden flooring materials, vinyl flooring materials and "no-wax" flooring materials. Such flooring materials often require particular specialized formulations such as among the compositons exemplified above, and/or particular care which is often labor intensive or may the involve usage of large amounts of water for dilution which may potentially damage wooden flooring materials. Thus, they may not be easy to apply, and concomitantly discourage their frequent use, which in turn compounds the problem of accumulated soils and stains upon flooring materials.

Further, a great number of such known floor cleaning products include a substantial amount of one or more organic compounds, particularly traditional soap constituents, in a large amount which have been found to cause the deposition and/or formation of undesired surface deposits such as surface streaks or sticky films. Such floor cleaning products containing volatile organic materials which may damage the finish applied to a flooring surface, which volatile organic materials are also becoming increasingly undesirable for environmental and user/worker safety concerns. A further shortcoming of many known art compositions is a tendency to leave residual films which may be accumulated over time, i.e., "built up", which are difficult to remove during a floor refinishing operation where sanders or other floor abrading devices or abrading materials are used. Such built up residual films undesirably clog such abrading devices or abrading materials requiring frequent cleaning thereof, and/or consumption of the abrasive materials at an undesirable rate. Since the film is difficult to remove completely, the newly coated floor finish may impart defects such as swelling, loss of adhesion and/or change in gloss.

Thus, from the foregoing there is a demonstrated need for improvements in floor cleaning compositions, particulary floor cleaning compositions which feature one or more of the following characteristics: easy to use, effective cleaning action, substantial reduction or virtual elimination of surface film formation, cleaning formulation which does not contain a traditional soap constituent, low solids content, and no organic material content in amounts which may damage the floor finish.

Still further objects of the invention include improved methods for the production of floor cleaning compositions, methods for the use of such compositions, as well as improved methods for the cleaning of flooring surfaces, particularly wood flooring surfaces.

In accordance with the present invention there is provided an improved floor cleaning compositions which satisfies one or more of the objects recited above.

The present inventive floor cleaning compositions comprise the following constituents:

A) nonionic surfactant composition having an average molecular weight of about 2,000 or greater;

B) an amphoteric hydrotrope;

C) anionic surfactant composition;

D) water.

Optional further constituents include further solubilizing agents/compatabilizing agents, fragrances, coloring agents, pH adjusting agents, buffers, preservatives, antioxidants a well as other conventional additives known to the art relating to such floor cleaning compositions. The preferred optional constituents generally are present in only minor amounts, generally comprising a total of less than 20% by weight of the total weight of a composition.

Preferred compositions of the invention exclude a traditional soap constituent as a cleaning agent, as well as organic solvents for the purpose of soil penetration.

Constituent A) Nonionic surfactants which are useful in the compositions of the instant invention are water soluble or water dispersible non-ionic surfactant compositions known to the art. Exemplary non-ionic surfactants include the primary alcohol ethoxylates, secondary alcohol ethoxylates, alkylphenol ethoxylates, alkylaminoalkoxylates and ethylene-oxide-propylene oxide condensates on primary alkanols. Nonionic surfactants include the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol and/or polypropylene glycol, to form a water soluble nonionic surfactant. Further, the length of the polyethenoxy hydrophobic and hydrophilic elements may vary.

Nonionic surfactants include the condensation products of a higher alcohol (e.g., an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide (EO), tridecanol condensed with about 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

Exemplary nonionic surfactants are the Neodol® ethoxylates (Shell Co. Houston, Tex.), which are aliphatic, primary alcohol containing about 9–15 carbon atoms, such as $C_9$–$C_{11}$ alkanol condensed with 8 moles of ethylene oxide (Neodol® 91-8), $C_{12-13}$ alkanol condensed with 6.5 moles ethylene oxide (Neodol® 23-6.5), $C_{12-15}$ alkanol condensed with 12 moles ethylene oxide (Neodol® 25-12), $C_{14-15}$ alkanol condensed with 13 moles ethylene oxide (Neodol® 45-13), and the like.

Additional examples of water soluble nonionic surfactants based on alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO units include Tergitol® 15-S-9 (Union Carbide, Danbury Conn.) or 12 EO units such as Tergitol® 15-S-12 (Union Carbide, Danbury Conn.).

Further water soluble nonionic surfactants include alkyl ethoxylated/propoxylated alkanols, particularly $C_8$–$C_{24}$ ethoxylated/propoxylated alcohols, particularly $C_{10}$–$C_{16}$ ethoxylated/propoxylated alcohols. Examples of such compositions include those presently marketed as Tergitol® MDS-42 (Union Carbide, Danbury Conn.).

Other exemplary nonionic detergents include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include nonyl condensed with about 9.5 moles of EO per mole of nonyl phenol, dinonyl phenol condensed with about 12 moles of EO per mole of phenol, dinonyl phenol condensed with about 15 moles of EO per mole of phenol and diisoctylphenol condensed with about 15 moles of EO per mole of phenol. Commercially available nonionic surfactants of this type include Igepal® CO-630, (ISP Corp., Wayne N.J.) described as being a nonyl phenol ethoxylate.

Further water-soluble nonionic surfactants are formed by condensing ethylene oxide with a hydrophobic base formed by the condensation of propylene oxide with propylene glycol. The molecular weight of the hydrophobic portion of the molecule is of the order of 950 to 4,000 and preferably 200 to 2,500. The addition of polyoxyethylene radicals to the hydrophobic portion tends to increase the solubility of the molecule as a whole so as to make the surfactant water-soluble. The addition of the polyoxypropylene aids in the solubilization of grease and oil which may be present in soils intended to be removed by the inventive composition. The molecular weight of the block polymers varies from 1,000 to 15,000 and the polyethylene oxide content may comprise 20% to 80% by weight. Examples of these surfactants in liquid form are available under the Pluronics® tradename as Pluronics® L62 and Pluronics® L64.

In the compositions according to the present invention, a nonionic surfactant which features little or no foam formation is desirably used.

Preferred nonionic surfactants which are used in the compositions of the invention are those wherein the surfactant has an average molecular weight of about 2,000 and greater, and more preferably of about 2,000 to about 8,000. Most desirably, the nonionic surfactants have an average molecular weight in the range 2,000–8,000. The inventor has found that the very low molecular weights, i.e., less than about 2,000 provide good cleaning action and soils removal, but may undesirably penetrate or damage flooring finishes. Conversely, while the higher molecular weight materials, those in excess of about 8,000 exhibit no appreciable deleterious effect to flooring finishes, their cleaning performance may be somewhat unsatisfactory. Thus, those having average molecular weights within the range noted above have been found to provide the best cleaning efficacy while minimizing the potential of damage to flooring finishes and flooring surfaces.

Representative examples of preferred nonionic surfactants include those which are presently commercially available include alkylaminoalkoxylates. Particulary preferred alkylaminoalkoxylates are compounds which are represented by the formula:

$$R-\overset{\overset{\displaystyle H}{|}}{N}-(CH_2CH_2O)_x-(CH_2CH_2CH_2O)_y$$

wherein R is a linear or branched hydrocarbon radical containing 1 to 12 carbon atoms; and, x and y are integer numbers selected so that the total molecular weight of the compound exhibits an average molecular weight of from about 2000 to about 8000.

With reference to the formula above, R is preferably a substantially linear hydrocarbon radical containing about 8–10 carbon atoms, and x and y are preferably selected so that the total molecular weight of the compound exhibits an average molecular weight of about 4000 to about 7000, but even more preferably is about 6000.

An exemplary alkylaminoalkoxylate having a substantially linear hydrocarbon radical of from about 8–10 carbon atoms is Triton® CF-32 (Union Carbide, Danbury Conn.).

A further preferred class of nonionic surfactants include alkyloxypolyalkyleneoxyalkanols, particularly $C_{10}$–$C_{16}$ alkyloxypolyalkyleneoxyalkanols, most particularly those which may be represented in accordance with the following general formula:

$$C_xH_y-O-(CH_2\overset{\overset{\displaystyle CH_3}{|}}{C}HO)_n-(CH_2CH_2O)_m-CH_2\overset{\overset{\displaystyle CH_3}{|}}{C}H-OH$$

where x is from 8–24, more preferably 10–16;

y is from 17–49, more preferably 21–33;

and n and m are integer numbers selected so that the total molecular weight of the compound exhibits an average molecular weight of from about 2000 to about 8000, more preferably from about 4000 to about 7000, but most desirably a molecular weight of about 6000.

Exemplary alkyloxypolyalkyleneoxyalkanols include those which are presently commercially available under the name Tergitol® MDS-42 (Union Carbide, Danbury Conn.).

A still further preferred class of useful nonionic surfactants include those which are referred to a amine polyglycol condensates, particularly those exhibiting an average molecular weight of about 2000 and greater, more particularly those exhibits an average molecular weight of from about 2000 to about 8000. Such amine polyglycol condensates include known art compositions, including those which are presently commercially available as Triton® CF-32 (Union Carbide, Danbury Conn.).

In accordance with the present invention the nonionic surfactant according to Constituent A is preferably present in amount of from about 0.001% by weight to about 10%, more preferably in an amount of about 5% by weight and less, still more preferably in amounts of about 2% by weight and less and most preferably in amounts of about 1% by weight and less, based on the total weight of the liquid floor cleaning composition.

Constituent B) A further constituent according to the invention is an amphoteric hydrotrope composition which is effective in improving the solubility of the nonionic surfactant of constituent A in water. This constituent is desirable included in an amount effective in clarifying the composition, particularly to be effective as a solubility enhancer at room temperature, viz., approximately 20° C., as well as elevated temperatures, viz., approximately 40° C.

The amphoteric hydrotropes useful in the use of the compositions of the present invention include known art hydrotrope compositions. Suitable hydrotropes include salts of aryl sulfonic acids such as naphtyl and benzene sulfonic acids, wherein the aromatic nucleus may be unsubstituted or substituted with lower alkyl groups, such as $C_{1-4}$ alkyl groups, especially methyl, ethyl and/or isopropyl groups. Up to three of such substituents may be present in the aromatic nucleus, but preferably zero to two are preferred. The salt forming cation of the hydrotrope is preferably an alkali metal such as sodium or potassium, especially sodium. However, other water soluble cations such as ammonium, mono-, di- and tri- lower alkyl, i.e., $C_{1-4}$ alkanol ammonium groups can be used in the place of the alkali metal cations. Exemplary hydrotropes include benzene sulfonates, o-toluene sulfonates, m-toluene sulfonates, and p-toluene sulfonates; 2,3-xylene sulfonates, 2,4-xylene sulfonates, and 4,6-xylene sulfonates; cumene sulfonates, wherein such exemplary hydrotropes are generally in a salt form thereof. Further exemplary hydrotropes include lower alkyl sulfate salts, particularly those having from about one to six carbon atoms in the alkyl group. Certain of these hydrotropes are also known as surfactants.

In certain preferred embodiments of the invention, the amphoteric hydrotrope is Amphoterge® K-2, (Lonza Inc., Fair Lawn, N.J.) which is described to be cocoamphocarboxyglycinate, which is also described to be an amphoteric surfactant.

Desirably, constituent B is present in a particular ratio range relative to the amount of constituent A present in a composition. Such weight ratios of Constituent A:Constituent B are from 1:1–10 Preferably 1:3–7, and most preferably about 1:3–4.

In accordance with the present invention the nonionic surfactant according to Constituent A is preferably present in amount of from about 0.001% by weight to about 10%, more preferably in an amount of about 5% by weight and less, still more preferably in amounts of about 2% by weight and less and most preferably in amounts of about 1% by weight and less, based on the total weight of the liquid floor cleaning composition.

Constituent C) The compositions according to the present invention includes an anionic surfactant composition. Desirably, the anionic surfactant composition further functions as a synthetic detergent effective in the removal of the particulate soils, and optionally as a co-hydrotrope in conjunction with constituent B so to clarify constituent A of the present inventive compositions. The preferred anionic surfactant composition, also referred to as anionic surfactants, are selected to exhibit good detersive efficacy, and desirably low foaming action.

Exemplary anionic surface active agents include compounds known to the art as useful as anionic surfactants. These include but are not limited to: alkali metal salts, ammonium salts, amine salts, aminoalcohol salts or the magnesium salts of one or more of the following compounds: alkyl sulfates, alkyl ether sulfates, alkylamidoether sulfates, alkylaryl polyether sulfates, monoglyceride sulfates, alkylsulfonates, alkylamide sulfonates, alkylarylsulfonates, olefinsulfonates, paraffin sulfonates, alkyl sulfosuccinates, alkyl ether sulfosuccinates, alkylamide sulfosuccinates, alkyl sulfosuccinamate, alkyl sulfoacetates, alkyl phosphates, alkyl ether phosphates, acyl sarconsinates, acyl isethionates, and N-acyl taurates. Generally, the alkyl or acyl radical in these various compounds comprise a carbon chain containing 12 to 20 carbon atoms.

The inventors have found that certain carboxylated alcohol alkoxylate compounds are particularly effective and are advantageously incorporated into the concentrate compositions of the invention as Constituent C. These include carboxylated alcohol alkoxylate surfactants according to the following general formula:

$$R-O-(\underset{X}{\underset{|}{CH}}-\underset{Y}{\underset{|}{CH}}-O)_n-Z$$

wherein R is a hydrophobic group, more preferably a $C_6$–$C_{18}$ alkyl group, n is a number in the range of 1 to 24, X and Y are independently selected from the group consisting of hydrogen, succinic acid radical, hydroxysuccinic acid radical, citric acid radical, and mixtures thereof, wherein at least one of X or Y is a succinic acid radical, hydroxysuccinic acid radical, or citric acid radical, and Z is H or $-CH_2COOH$. Certain anionic surfactants according to the immediately preceding general formula are presently commercially available as the Poly-Tergent® C series of anionic surfactants from the Olin Chem. Co., (Stamford, Conn.). Particularly preferred amongst these are the Poly-Tergent® CS-1 composition which is believed to being a composition according to the formula above wherein R is a $C_6$–$C_{18}$ alkyl group, X and Y are independently H, $CH_3$ or the succinic acid radical with at least one succinic acid radical being present, and where Z is H.

A further class of particularly effective low foaming anionic surfactant compositions which are useful in Constituent C of the instant invention surfactant compostions based on sulfonated alcohols (straight chained or branched), as well as metal salts and/or ammonium salts thereof. Examples of such compositions include those presently commerically available under the trade name Rhodapon® (Rhône-Poulenc, Cranbury, N.J.), including Rhodapon® BOS based on sodium 2-ethylhexyl sulfate.

A yet further particularly effective low foaming anionic surfacant useful in Constituent C according to the present invention include certain alkyl acetate derivatives, as well as as metal salts and/or ammonium salts thereof. An exemplary composition includes an anionic wetting agent presently commercially available as Miranate® (Rhône-Poulenc, Cranbury, N.J.), which is generally described to be an alkyl carboxyl derivative, and more specifically described as being sodium butoxyethoxy acetate.

Other known anionic surfactants, while not particularly enumerated here may also find use as Constituent C of the present inventive compositions. Also, mixtures of one or more anionic surfactants may be used as Constituent C.

In accordance with the present invention the nonionic surfactant according to Constituent A is preferably present in amount of from about 0.001% by weight to about 10%, more preferably in an amount of about 5% by weight and less, still more preferably in amounts of about 2% by weight and less and most preferably in amounts of about 1% by weight and less, based on the total weight of the liquid floor cleaning composition.

Constituent D) A major constituent of the inventive compositions is water. Water is added to Constituent A, B, and C in order to provide 100% by weight of the compositions of the invention. The water may be tap water, but is preferably distilled and/or deionized water. If the water is tap water, it is preferably appropriately filtered in order to remove any undesirable impurities such as organics or inorganics, especially minerals salts which are present in hard water which may thus interfere with the operation of Constituents A, B and C, as well as any other optional components of the liquid concentrates according to the invention. Deionized water is most preferred, due to the absence of ions. Generally, water is present in the compositions in amounts in excess of about 80% by weight, preferably in amounts of in excess of 90% by weight, but most preferably in amount of between 95% and 99% by weight based on the total weight of Constituents A–D in the concentrate compositions according to the invention.

Optional Constituents) The floor cleaning compositions of the invention may comprise one or more further optional constituents. By way of non-limiting example, these include further solubilizing agents/compatabilizing agents, surfactants including anionic, cationic, non-ionic, and amphoteric surfactants, fragrances, coloring agents, pH adjusting agents, pH buffering agents, preservatives, antioxidants, water softening agents, as well as other conventional additives known to the art. Such further surfactants and optional constiuents include known art compositons, certain such exemplary compositions are described in *McCutcheon's Detergents and Emulsifiers*, North American Edition, 1982; *Kirk-Othmer, Encyclopedia of Chemical Technology*, 3rd Ed., Vol. 22, pp. 346–387, the contents of which are herein incorporated by reference. Mixtures of two or more such surface active agents may be incorporated into the inventive compositions.

Further optional, but desirable constituents include fragrances, natural or synthetically produced. Such fragrances may be added in any conventional manner, admixing to a concentrate composition or blending with other constituents used to form a concentrate composition, in amounts which are found to be useful to enhance or impart the desired scent characteristic to the concentrate composition, and/or to cleaning compositions formed therefrom.

In compositions which include a fragrance, it is frequently desirable to include a fragrance solubilizer which assists in the dispersion, solution or mixing of the fragrance constituent in an aqueous base. This is very practical in low solid content formulations such as that taught herein, so to aid in the solubilization of oil based fragrances into an aqueous system. These include known art compounds, including condensates of 2 to 30 moles of ethylene oxide with sorbitan mono- and tri-$C_{10}$–$C_{20}$ alkanoic acid esters having a HLB of 8 to are also known as nonionic surfactants. Further examples of such suitable surfactants include water soluble nonionic surfactants of which many are commercially known and by way of non-limiting example include the alcohol ethoxylates, alkylphenol ethoxylates and ethylene-oxide-propylene oxide condensates on primary alkanols, and condensates of ethylene oxide with sorbitan fatty acid esters. This fragrance solubilizer component is added in minor amounts, particularly amount which are found effective in aiding in the solubilization of the fragrance component, but not in any significantly greater proportion, such that it would be considered as a detergent constituent. Such minor amounts recited herein are dependent on the amount of fragrance used generally up to about 0.5% by weight of the total composition but is more generally an amount of about 0.1% by weight and less, and preferably is present in amounts of about 0.05% by weight and less.

Further optional, but advantageously included constituents are one or more coloring agents which find use in modifying the appearance of the concentrate compositions and enhance their appearance from the perspective of a consumer or other end user. Known coloring agents, may be incorporated in the compositions in any effective amount to improve or impart to concentrate compositions a desired appearance or color. Such a coloring agent or coloring agents may be added in a conventional fashion, i.e., admixing to a concentrate composition or blending with other constituents used to form a concentrate composition.

The use of one or more pH adjusting agents, including agents known to the art such a minor amounts of mineral acids, basic compositons, and organic acids may be used. An exemplary composition includes citric acid, such as is available in an anhydrous form. The compositions according to the invention are preferably alkaline in character, exhibiting a pH of 7.0 or greater. Most desirably, the pH of the inventive compositions are in the range of from about 8.0 to about 9.0 which may be achieved by the addition of an effective amount of citric acid in an anhydrous form, which generally is required in amounts of from about 0.001–0.04% by weight of the composition. While the composition of the invention generally does not require a pH adjusting agent, the use of such a pH adjusting agent may provide the benefit of stability of a preservative constituent which often requires certain pH range to be active and stable.

The addition of an effective amount of a pH buffering composition so to maintain the pH of the inventive compositions may also be added. While the composition of the invention generally does not require a pH buffering composition, the use of such a pH buffering composition may provide extra stability of a preservative constituent as well as for the whole system which concommitantly enhances the composition's shelf life. Any pH buffering compound or pH buffer composition which is compatible with the aqueous compositions taught herein may be used, and many of these are well known to the art. Examples of such useful pH buffer compounds and/or pH buffering systems or compositions the alkali metal phosphates, polyphospates, pyrophosphates, triphosphates, tetraphosphates, silicates, metasilicates, polysilicates, carbonates, hydroxides, and mixtures of the same. Certain salts, such as the alkaline earth phosphates, carbonates, hydroxides, can also function as buffers. It may also be suitable to use buffers such materials as aluminosilicates (zeolites), borates, aluminates and certain organic materials such as gluconates, succinates, maleates, and their alkali metal salts. Such buffers keep the pH ranges of the compositions of the present invention within acceptable limits. Others, not particularly elucidated here may also be used. Preferably, citric acid, such as is available in an anhydrous form is added as it is readily commercially available, and effective.

Preservatives may also be added in minor amounts, and known art compostions may be used. Examples of such preservatives compounds include those which are presently commercially available under the tradenames Kathon CG/ICP (Rohm & Haas, Philadelphia, Pa.), Suttocide® A (Sutton Labs, Chatham N.J.) as well as Midtect® TFP (Tri-K Co., Emerson, N.J.). Such preservative compositions are generally added in only minor amounts, i.e, amounts of about 1% by weight of the total composition, more generally an amount of about 0.5% by weight and less, and preferably is present in amounts of about 0.1% by weight and less based upon usage recommended in product literature.

Such optional, i.e., non-essential constituents including those recited above are generally are present in only minor amounts, generally comprising a total of less than 20% by weight of the total weight of a composition. Preferably, as has been noted the compositions do not include a builder, or an organic solvent as a soil detergent agent. Organic solvents are desirably excluded as the present inventors have found that the contact of one or more organic solvents, especially prolonged contact, is often deleterious to the floor finish, particularly to flooring surfaces coated or treated with a finishing composition based on one or more organic polymers, including polyurethanes, varnishes, shellacs, as well as more recently available aqueous polymer dispersions such as that marketed as Polycrylics® (Minwax Co., Montville N.J.), and the like. They may, however, be added in minor amounts as solubilizing agents for fragrances which may be optionally, but desirably, included in the present inventive compositions. The optional constituents should also be selected so to have little or no detrimental effect upon the desirable cleaning behavior provided by the inventive compositions, and the amounts at which they are incorporated into the compositions of the invention should be minimized so as not to cause any undesirable film formation or build-up upon the flooring surfaces being treated.

The inventor has surprisingly found that by the careful selection of the constituents described above, excellent floor cleaning compositions may be produced which provide good cleaning without deleterious effects and with little or no film deposition upon the cleaned flooring surface. That this may be achieved with compositions comprising such a high percentage of water in their constituency and/or without the need of traditional soap constituents is a surprising and important technical benefit not heretofore realized in the art.

The floor cleaning compostions are used in a conventional manner, and are preferably used without further aqueous dilution. Desirably, the floor cleaning compostions are sprayed or sprinkled onto a floor needing cleaning, such as from a conventional spray bottle, conventional squeeze bottle, or the like, and distributed by the use of a sponge or mop in a manual cleaning operation, or in a mechanical cleaning operation by the use of a motorized floor cleaning apparatus having a sponge. The sponge or mop may be predampened with water, or may be dry but is desirably predampened with the excess water squeezed out. Such dampening ensures that the flooring cleaning composition is not unduly absorbed and entrained in the interior of the mop or sponge. After application, the mop or sponge may be rinsed, as in a bucket of water, and applied floor cleaning composition wiped from the cleaned flooring surface.

The compositions of the invention may also be used as a general purpose cleaners for finished wood surfaces, such as furniture, moldings, trim and the like.

While described in terms of the presently preferred embodiments, it is to be understood that the present disclosure is to be interepreted as by way of illustration, and not by way of limitation, and that various modifications and alterations apparent to one skilled in the art may be made without departing from the scope and spirit of the present invention.

EXAMPLES

Various exemplary formulations according to the present inventive teaching are described in more detail on Table I, below. Generally, each of the indicated exemplary formulations was formed by simple mixing, namely, the addition of measured amounts of each of the single constituents into the water, followed by manual stirring with a stirring rod, or alternately by the use of a magnetic stirrer. For compositions wherein a fragrance material is included, measured amounts of the fragrance and fragrance solubilizer were first mixed with the nonionic surfactant constituent to form a premixture. Subsequently the premixture was added by simple mixing into the water, followed by the other remaining constituents.

Table I also indicates several "comparative examples" which are designated Comp. 1, Comp.2, and Comp.3 which illustrate the use of organic solvents, and/or builders, and/or non-ionic surfactant compostions having average molecular weight outside of the scope of the preferred average molecular weight ranges taught as being within the scope of the present invention, especially within the scope of preferred embodiments according to the present inventive concept.

All of the constituents are indicated as parts by weight based on 100 parts by weight for a composition.

TABLE I

| | Ex. 1 | Ex. 2 | Ex. 3 | Ex. 4 | Ex. 5 | Ex. 6 | Ex. 7 | Comp. 1 | Comp. 2 | Comp. 3 |
|---|---|---|---|---|---|---|---|---|---|---|
| Constituent: | | | | | | | | | | |
| Nonionic surfactant[1a] | 0.24 | 0.14 | 0.14 | 0.14 | 0.14 | 0.14 | 0.14 | — | — | 0.24 |
| Nonionic surfactant[1b] | — | — | — | — | — | — | — | 0.4 | 0.4 | — |
| Nonionic surfactant[1c] | — | — | — | — | — | — | — | 0.05 | 0.05 | — |
| Amphoteric surfactant[2] | 0.20 | 0.60 | 0.50 | 0.45 | 0.50 | 0.50 | 0.50 | — | — | 0.16 |
| Anionic surfactant[3] | 0.05 | 0.05 | 0.05 | 0.05 | 0.05 | 0.05 | 0.05 | 0.05 | 0.05 | 0.05 |
| water | to 100 | to 100 | to 100 | to 100 | to 100 | to 100 | to 100 | to 100 | to 100 | to 100 |
| fragrance[4] | — | — | — | — | 0.03 | 0.03 | 0.03 | — | — | — |
| fragrance solubilizer[5] | — | — | — | — | 0.04 | 0.04 | 0.04 | — | — | — |
| preservative[6] | — | — | — | — | 0.10 | 0.10 | 0.05 | — | — | — |
| builder[7] | — | — | — | — | — | — | — | 0.10 | 0.10 | — |
| solvent[8a] | — | — | — | — | — | — | — | 0.15 | — | — |
| solvent[8b] | — | — | — | — | — | — | — | 1.35 | — | 1.35 |
| acid[9] | — | — | — | — | — | 0.03 | — | — | — | — |

[1a]Nonionic surfactant = alkylaminopolyethoxypolypropoxypropanol, Triton ® CF-32 (Union Carbide, Danbury CT.)
[1b]Nonionic surfactant = a C11–C15 secondary alcohol ethoxylate, average molecular weight = 552; Tergitol ® 15-S-9 (Union Carbide, Danbury CT)
[1c]Nonionic surfactant = a C12–C16 alcohol ethoxylate, with an average of 3 ethoxy groups, average molecular weight = 328; Genapol ® 26-L-3 (Hoechst-Celanese, Charlotte NC)
[2]Amphoteric surfactant = a disodium cocoamphodipropionate, Amphoterge ® K-2 (Lonza, Inc., Fair Lawn, NJ)
[3]Anionic surfactant = carboxylated alcohol alkoxylate, Poly-Tergent ® CS-1 (Olin Chem. Corp., Stamford CT)
[4]fragrance = WS3064
[5]fragrance solubilizer = Tween ® 20 (ICI Corp., Wilmington DE) condensates of ethylene oxide with sorbitan fatty acid esters
[6]preservative = Kathon ® CG/ICP preservative composition (Rhône-Poulenc, Cranbury NJ)
[7]builder = $Na_2SiO_3$
[8a]solvent = dipropylene glycol n-propyl ether
[8b]solvent = dipropylene glycol methyl ether
[9]acid = citric acid, anhydrous Surface Testing:

Determination of any deleterious effects upon a variety of surfaces were evaluated for various exemplary compositions in accordance with the following general protocol. An approximately 20 grams sample of an example composition shown on Table I was dropped onto a horizontal wood panel surface which was coated with two coats of a polyurethane finish coating or three coats of a Polycrylic® (Minwax Corp., Montvale N.J.) finish coating. After the passage of either a 1 hour, 2 hour or a 16 hour time period, the example composition was wiped off by the use of an absorbent paper towel or sponge, and any surface effects or marks were ascertained by visual inspection.

The results of the surface testing for compositions according to Examples 1 through Example 7, as well as those of Comparative Examples 1 through 3 (preceeded by the letter "C.") are summarized on Table II below. It was observed that each of the compositions was dear to slightly hazy at room temperature (20°–22° C.).

TABLE II

| Example: | 1 | 2 | 3 | 4 | 5 | 6 | 7 | C.1 | C.2 | C.3 |
|---|---|---|---|---|---|---|---|---|---|---|
| polyurethane (1 hr.) | — | — | — | — | N | N | — | — | — | — |
| polyurethane (2 hrs.) | N | — | — | — | — | — | — | Y | Y | Y |
| polyurethane (16 hrs.) | N | N | N | N | — | — | N | — | — | — |
| Polycrylic ® (2 hrs.) | N | — | — | — | — | — | — | — | — | — |

With respect to Table II, a result of "N" indicates that no detrimental effect upon the surface for the time interval tested could be visually seen. A result a "--" indicates that no test was performed for the indicated example composition and surface. A result of "Y" indicates that damage to the flooring surface and/or flooring coating material was observed.

The composition according to Example 6 was also tested on the following materials which had been applied to a wood surface sample and allowed to thoroughly dry to a hard surface: 4 coats of a commerically available lacquer composition (Sheffield Bronze Paint Co., Cleveland Ohio); 3 coats of a commerically available varnish compositon (McClosky Co.); and, 4 coats of a commerically available paint, Glidden Spread 2000, (Glidden Co., Cleveland Ohio). The composition according to Example 6 was tested as noted above for a one (1) hour period, after which each sample was visually inspected and evaluated. No deleterious surface effects were observed for these samples.

As the results indicate, the tested exemplary compositions described in more detail in Table I exhibit no appreciable deleterious effects to the surfaces tested, which surfaces are typical of finished wood flooring surfaces. Conversely, the compositions according to the comparative examples were observed to damage the flooring coating, here polyurethane. Such damage is believed to be attributable to the types of nonionic surfactants included in the comparative formulations, all of which shared the common characteristic of having an average molecular weight of less than 2000. Such lower molecular weight surfactants provided good cleaning, but also an increased potential for damage to the flooring material or floor coating. Similarly, comparative formulations comprising an appreciable amount of an organic solvent, viz., amounts in excess of that required to aid in the solubilization of the a fragrance and not more, were also found to damage the flooring coating. Such organic solvents, when present in such amounts sufficient to act as a detersive active agent, were believed to soften and/or solubilize components of the polyureathane coating on the flooring surface sample being tested.

Preparation of Cleaning Compositions:

Further testing was performed utilizing one or more of the exemplary compositions within the scope of the invention as illustrated on Table I, and cleaning compositions prepared from known commercially available cleaning products, which are indicated as comparative examples. These cleaning compositions provided as further comparative examples were produced in accordance with the following description.

Comparative Example IV

A cleaning composition was formed by forming an aqueous dilution of one part by weight of Murphy's® Oil Soap, a commercially available cleaning concentrate with 32 parts by weight of water at 30°–40° C. and subsequently manually stirring the same to form a uniform mixture. The percentage of solids in the mixture was evaluated to be 0.6%.

Comparative Example V

A cleaning composition was formed by forming an aqueous dilution of one quarter cup of Murphy's® Oil Soap, a commercially available cleaning concentrate with 1 gallon of water at room temperature (approx. 20° C.) and subsequently manually stirring the same to form a uniform mixture. The percentage of solids in the mixture was determined to be 0.3%.

Comparative Example VI

A commercially available cleaning composition, "Dura-Luster Cleaner" (Basic Coatings Co., Des Moines Iowa), marketed as a cleaner for residential hardwood floors was applied from the container without further dilution.

Comparative Example VII

A cleaning composition was formed by mixing one-quarter cup of a commercially available cleaning formulation, "Poly-Care" (Absolute Coatings Inc., New Rochelle N.Y.), marketed as a cleaner concentrate formulation for residential hardwood floors with one gallon of water 30°–40° C., and manually stirring the same to form a cleaning composition therefrom. This cleaning composition was evaluated to contain 0.3% solids by weight.

Comparative Example VIII

A cleaning composition was formed by mixing one-quarter cup of a commercially available cleaning concentrate, "Oil Soap"(Grossman's Co., Braintree Mass.), marketed as a cleaner concentrate formulation for residential hardwood floors with one gallon of water 30°–40° C., and manually stirring the same to form a cleaning composition therefrom. This cleaning composition was evaluated to contain 0.6% solids by weight.

Surface Cleaning Efficacy:

The cleaning efficacy of both exemplary cleaning compositions as well as cleaning compositions formed from known art cleaning compositions was evaluated was evaluated in accordance with the following protocol. An approximate 2 gram sample of a greasy particulate laden soil made from a mixture of corn starch, potting soil, pasty food shortening, mineral spirits and oil lubricant, was applied to a wood panel sample which has either a commercially available polyurethane coated composition or a Polycrylic® hard (Minwax Corp., Montville N.J.) coating composition according to label instructions to form a fully dried, coated surface thereon. Such surface coatings are typical of finished wood flooring surfaces. The soil was allowed to age undisturbed at room temperature for 4 to 5 hours. Subsequently, about 2–3 grams of a cleaning composition was squirted onto a damp sponge (water dampened) of a Gardener Abrasion Tester (Gardener Co., Silver Spring Md.), and the machine was energized to cycle 3–5 times. The wood sample panel was then removed and visually inspected to evaluate the cleaning efficacy of the prepared cleaning compositions. The results are reported on Table III, below.

TABLE III

| | Example 7 | Example 3 | Comp. Example IV |
|---|---|---|---|
| polyurethane | 5 | 5 | 2 |
| Polycrylic ® | 4 | 4 | 1 |

The results are indicated in a numerical ranking with complete soil removal indicated by a "5" as determined by visual inspection, "good" cleaning results indicated as "4", "satisfactory" or "fair" cleaning results indicated by "3", or "poor" results characterized by "2", and "very poor" results indicated by a "1", and no soil removal indicated by a "0".

As can be seen from the results of Table III, the cleaning efficacy of the compositions according to the invention provided significantly better cleaning action on the tested soil and wood surface than that of the commercially available cleaning preparation.

Cleaning evaluations were also perfomed in accordance with the testing protocol outlined according to ASTM D4488 A2 Test Method, which evaluated the efficacy of the cleaning compositions on masonite wallboard samples painted with wall paint. The soil applied was a greasy soil sample containing vegetable oil, food shortening and animal fat. The sponge (water dampened) of a Gardner Abrasion Tester apparatus was squirted with a 15 gram sample of a tested cleaning composition, and the apparatus was cycled 10 times. The evaluation of cleaning compositions was "paired" with one side of each of the test samples treated with a composition according to the invention, and the other side of the same sample treated with a comparative example's composition, thus allowing a "side-by-side" comparision to be made. The cleaning efficacy of the tested compositions was evaluated utililzing a Minolta Chroma Meter CF-110, with Data Processor DP-100, which evaluated spectrophotomic characteristics of the sample. The results are reported on Table IV following.

TABLE IV

| compositon / comparative composition | Ex. 6 / Comp. Ex. VI | Ex. 6 / Comp. Ex. VII |
|---|---|---|
| reflectance reading: composition / comparative composition | 60.7 / 58.1 | 58.7 / 54.9 |

With respect to the results reported on Table IV, a value of "100" is indicative of a white (unsoiled) background, and a "0" value is indicative of a black background. A soil laden (uncleaned) surface generally provided a result of about 20–30.

As can be seen from the results of Table IV, the cleaning efficacy of the composition according to the invention provided improved results over those of known art cleaning products.

Surface Film Formation Testing:

The tendency to form surface deposits or surface films was determined for certain of the example compositions shown on Table I as well as for Comparative Example compositions indicated above.

In accordance with such testing, a 1–2 gram sample of a cleaning composition is dropped onto a black glass sample plate onto which has been provided a hard, dried polyurethane coating 1 layer thick. The cleaning composition is spread into a thin film on the surface of the sample plate by the use of a dampened (water) sponge. Subsequently, the sample plate and film are heated by the use of a hair dryer until no liquid drops are left upon the surface of the sample plate.

A similar procedure to that recited immediately above was also performed using a wood surface which had been provided with a coat of gloss black paint, with a slightly larger amount of compositions being applied, and with multiple applications.

The results of the test are indicated on Table V, below.

TABLE V

| | Example 5 | Example 6 | Comp. V | Comp. VIII |
|---|---|---|---|---|
| glass/polyurethane sample | 1 | 1 | 3 | 4 |
| wood/painted surface sample | 0 | 1 | 3 | — |

Therein are indicated results in the following ranked order: "0" is indicative of no visible residue or film; "1" is indicative of only slightly visible deposits and/or slightly visible streaks; "2" is indicative of moderately visible deposits and/or moderately visible streaks or grayish or whitish filming; and "3" is indicative of noticeable surface deposits and/or noticeable grayish or whitish film formation, "4" is indicative of pronounced surface deposits and or a pronounced grayish or whitish film, and "5" is indicative of heavy, or strong, filming.

As can be seen from the foregoing, the present inventive compositions provide effective cleaning compositions which are easy to use and which have little tendency to leave surface deposits, particularly film forming deposits or streaks. As an examination of the various example formulations also reveals, such effective cleaning action is provided with a minimal amount of organic compounds being present in the compositions, which provides no deleterious effects on wood finishes and concomitantly provides a reduced level of volatile organic materials.

I claim:

1. A floor cleaning composition comprising:

A) 0.001 to 10% by weight a nonionic surfactant composition having an average molecular weight of about 2,000 to about 8,000;

B) 0.001–10% by weight of an amphoteric hydrotrope;

C) 0.001 to 10% by weight of an anionic surfactant composition;

D) at least about 80% by weight water.

2. A floor cleaning composition according to claim 1 wherein the nonionic surfactant is a water dispersible nonionic surfactant selected from: primary alcohol ethoxylates, secondary alcohol ethoxylates, alkylphenol ethoxylates, alkylaminoalkoxylates and ethylene-oxide-propylene oxide condensates on primary alkanols.

3. A floor cleaning composition according to claim 1 wherein the nonionic surfactant is a water dispersible nonionic $C_8$–$C_{24}$ ethoxylated/propoxylated alcohol.

4. A floor cleaning composition according to claim 1 wherein the nonionic surfactant is an alkylaminoalkoxylate according to the formula:

$$R-\overset{\overset{\displaystyle H}{|}}{N}-(CH_2CH_2O)_x-(CH_2CH_2CH_2O)_y$$

where:

R is a linear or branched hydrocarbon radical containing 1 to 12 carbon atoms; and, x and y are integer numbers selected so that the total molecular weight of the compound exhibits an average molecular weight of from about 2000 to about 8000.

5. A floor cleaning composition according to claim 1 wherein the nonionic surfactant is an alkyloxypolyalkyleneoxyalkanol.

6. A floor cleaning composition according to claim 5 wherein the nonionic surfactant is an alkyloxypolyalkyleneoxyalkanol according to the formula:

$$C_xH_y-O-(CH_2\overset{\overset{CH_3}{|}}{C}HO)_n-(CH_2CH_2O)_m-CH_2\overset{\overset{CH_3}{|}}{C}H-OH$$

where x is from 8–24;

y is from 17–49;

and n and m are integer numbers selected so that the total molecular weight of the compound exhibits an average molecular weight of from about 2000 to about 8000.

7. A floor cleaning composition according to claim 5 wherein the nonionic surfactant is an alkyloxypolyalkyleneoxyalkanol according to the formula:

$$C_xH_y-O-(CH_2\overset{\overset{CH_3}{|}}{C}HO)_n-(CH_2CH_2O)_m-CH_2\overset{\overset{CH_3}{|}}{C}H-OH$$

where x is from 10–16;

y is from 21–33;

and n and m are integer numbers selected so that the total molecular weight of the compound exhibits an average molecular weight of from about 2000 to about 8000.

8. A floor cleaning composition 1 wherein the nonionic surfactant is an amine polyglycol condensate composition.

9. A floor cleaning composition according to claim 1 wherein the nonionic surfactant is an amine polyglycol condensate composition having an average molecular weight from about 2000 to about 8000.

10. A floor cleaning composition according to claim 1 wherein nonionic surfactant composition is present in amounts of from 0.001 to 5% by weight based on the total weight of the floor cleaning composition.

11. A floor cleaning composition according to claim 10 wherein nonionic surfactant composition is present in amounts of from 0.001 to 2% by weight based on the total weight of the floor cleaning composition.

12. A floor cleaning composition according to claim 1 wherein the anionic surfactant is selected from alkali metal salts, ammonium salts, amine salts, aminoalcohol salts or the magnesium salts of one or more of the following compounds: alkyl sulfates, alkyl ether sulfates, alkylamidoether sulfates, alkylaryl polyether sulfates, monoglyceride sulfates, alkylsulfonates, alkylamide sulfonates, alkylarylsulfonates, olefinsulfonates, paraffin sulfonates, alkyl sulfosuccinates, alkyl ether sulfosuccinates, alkylamide sulfosuccinates, alkyl sulfosuccinamate, alkyl sulfoacetates, alkyl phosphates, alkyl ether phosphates, acyl sarconsinates, acyl isethionates, and N-acyl taurates.

13. A floor cleaning composition according to claim 12 wherein the anionic surfactant is a carboxylated alcohol alkoxylate.

14. A floor cleaning composition according to claim 13 wherein the anionic surfactant is a carboxylated alcohol alkoxylate according to the formula:

$$R-O-(\underset{\underset{X}{|}}{C}H-\underset{\underset{Y}{|}}{C}H-O)_n-Z$$

where:

R is a hydrophobic group;

n is 1–24;

X and Y are independently selected from the group consisting of hydrogen, succinic acid radical, hydroxysuccinic acid radical, citric acid radical, and mixtures thereof, wherein at least one of X or Y is a succinic acid radical, hydroxysuccinic acid radical, or citric acid radical; and, Z is H or $-CH_2COOH$.

15. A floor cleaning composition according to claim 14 wherein the anionic surfactant is a carboxylated alcohol ethoxylate, where R is a hydrophobic $C_6$–$C_{18}$ alkyl group.

16. A floor cleaning composition according to claim 12 wherein the anionic surfactant is a sulfonated alcohol or metal or ammonium salt thereof.

17. A floor cleaning composition according to claim 16 wherein the anionic surfactant is selected from sodium alkyl sulfate, or 2-ethylehexyl sulfate.

18. A floor cleaning composition according to claim 12 wherein the anionic surfactant is an alkyl carboxyl derivative.

19. A floor cleaning composition according to claim 16 wherein the anionic surfactant is sodium butoxyethoxy acetate.

20. A floor cleaning composition according to claim 1 wherein anionic surfactant composition is present in amounts of from 0.001 to 5% by weight based on the total weight of the floor cleaning composition.

21. A floor cleaning composition according to claim 20 wherein anionic surfactant composition is present in amounts of from 0.001 to 2% by weight based on the total weight of the floor cleaning composition.

22. A floor cleaning composition according to claim 1 which further comprises at least one optional constituent.

23. A floor cleaning composition according to claim 22 wherein the at least one optional constituent is selected from: solubilizing agents/compatabilizing agents, surfactants including anionic, cationic, non-ionic, and amphoteric surfactants, fragrances, coloring agents, pH adjusting agents, pH buffering agents, preservatives, antioxidants, water softening agents.

24. The floor cleaning composition according to claim 23 wherein the at least one optional constituent comprises no more than 20% by weight of the floor cleaning composition.

25. A cleaning composition consisting essentially of:

A) nonionic surfactant composition wherein the surfactant has an average molecular weight of about 2,000 to about 8,000;

B) an amphoteric hydrotrope;

C) anionic surfacant composition;

D) water.

26. A floor cleaning composition according to claim 1 consisting essentially of:

A) 0.001–10% by weight of a nonionic surfactant composition wherein the surfactant preferably has an average molecular weight of about 2,000 or greater;

B) 0.001–10% by weight of an amphoteric hydrotrope;

C) 0.001–10% by weight of an anionic surfactant composition;

D) at least 80% by weight water.

27. A floor cleaning composition according to claim 25 which further comprises:

one or more optional constituents selected from: solubilizing agents/compatabilizing agents, surfactants including anionic, cationic, non-ionic, and amphoteric surfactants, fragrances, coloring agents, pH adjusting agents, pH buffering agents, preservatives, antioxidants, water softening agents.

28. A process for cleaning a flooring surface characterized by:

applying an effective amount of a floor cleaning composition according to claim 1 to a flooring surface.

* * * * *